United States Patent [19]

Ogawa

[11] Patent Number: 5,076,143

[45] Date of Patent: Dec. 31, 1991

[54] COUNTERBALANCE VALVE WITH A RELIEF FUNCTION

[75] Inventor: Kazunori Ogawa, Gifu, Japan

[73] Assignee: Teijin Seiki Co., Ltd., Osaka, Japan

[21] Appl. No.: 646,822

[22] Filed: Jan. 25, 1991

[30] Foreign Application Priority Data

Jan. 31, 1990 [JP] Japan ..... 2-21608

[51] Int. Cl.[5] ..... F15B 13/04

[52] U.S. Cl. ..... 91/420; 91/436; 91/447

[58] Field of Search ..... 91/420, 436, 447

[56] References Cited

FOREIGN PATENT DOCUMENTS 1929482 1/1970 Fed. Rep. of Germany ..... 91/447

54-44390 3/1979 Japan .

*Primary Examiner*—Gerald A. Michalsky

*Attorney, Agent, or Firm*—Rothwell, Figg, Ernst & Kurz

[57] ABSTRACT

A counterbalance valve with a relief function, disposed in a pair of supply and exhaust lines communicating a directional control valve with a fluid actuator for adjusting a flow area at an exhaust side of the supply and exhaust lines in response to a pressure at a supply side of the supply and exhaust lines, which includes two divided spools, corresponding to the supply and exhaust lines, respectively, as a spool of the counterbalance valve, a device for moving one of the divided spools at the supply side of the supply and exhaust lines in such a direction that the flow area increases in response to an increased pressure at the exhaust side of the supply and exhaust lines, when the pressure increases beyond a predetermined pressure due to a pumping function of the fluid actuator, and a communicating passage for communicating the exhaust side of the supply and exhaust lines with a supply side of the supply and exhaust lines when the moving device is actuated so that the fluid at the increased pressure at the exhaust side of the supply and exhaust lines is relieved to the supply side of the supply and exhaust lines.

3 Claims, 3 Drawing Sheets

COUNTERBALANCE VALVE WITH A RELIEF FUNCTION

FIELD OF THE INVENTION

The present invention relates to a counterbalance valve with a relief function, which valve is disposed in a pair of supply and exhaust lines communicating a directional control valve with a fluid actuator. Such a counterbalance valve adjusts a flow area at an exhaust side of the supply and exhaust lines in response to a pressure at a supply side of the supply and exhaust lines.

BACKGROUND OF THE INVENTION

In a conventionally known disposition of a counterbalance valve, as it is disclosed, for example, in Japanese Utility Model Application Laid-open No. Sho 54-44390, a counterbalance valve and a relief valve are disposed away from each other in a casing, and both the valves are communicated with each other by means of a plurality of passages.

However, in such a conventional disposition, a relief valve, the construction of which is complicated, is disposed in addition to a counterbalance valve, and further, a plurality of passages communicate the valves with each other. As a result, there are problems that the construction of the whole disposition is very complicated, and that accordingly, its manufacturing cost is expensive.

It is an object of the present invention to provide a counterbalance valve provided with a relief function which is simple in the whole construction.

It is another object of the present invention to provide a counterbalance valve which can be manufactured at a low cost, though it has a relief function.

SUMMARY OF THE INVENTION

According to the present invention, the above-described objects are achieved by a counterbalance valve with a relief function, which valve is disposed in a pair of supply and exhaust lines communicating a directional control valve with a fluid actuator, and which valve adjusts a flow area at an exhaust side of the supply and exhaust lines in response to a pressure at a supply side of the supply and exhaust lines, which further comprises:

two divided spools, which correspond to the supply and exhaust lines, respectively, and which compose a spool of the counterbalance valve;

a means for moving one of the divided spools at the supply side of the supply and exhaust lines in such a direction that the flow area increases in response to an increased pressure at the exhaust side of the supply and exhaust lines, when the pressure increases beyond a predetermined pressure due to a pumping function of the fluid actuator; and a communicating passage for communicating the exhaust side of the supply and exhaust lines with the supply side of the supply and exhaust lines when the moving means is actuated so that the fluid at the increased pressure at the exhaust side of the supply and exhaust lines is relived to the supply side of the supply and exhaust lines.

According to the present invention, when the directional control valve is switched to a flow position, a fluid having a high pressure flows into the supply side of the supply and exhaust lines, and the exhaust side of the supply and exhaust lines is communicated with a low pressure side. At this moment, the divided spool corresponding to the exhaust side of the supply and exhaust lines moves in response to the pressure in the supply side of the supply and exhaust lines, and thus, it adjusts the flow area in the exhaust side of the supply and exhaust lines.

When the fluid actuator begins to perform a pumping function, the pressure at the supply side of the supply and exhaust lines lowers while the pressure at the exhaust side of the supply and exhaust lines increases. In this case, when the pressure at the exhaust side of the supply and exhaust lines increases to a high pressure higher than a predetermined pressure, the moving means which receives the high pressure actuates so that the divided spool in the supply side of the supply and exhaust lines is moved in such a direction that the flow area is increased. As a result, the exhaust side of the supply and exhaust lines and the supply side of the supply and exhaust lines are communicated with each other through the communicating passage. Thus, the high pressure fluid in the exhaust side of the supply and exhaust lines is relieved to the supply side of the supply and exhaust lines through the communicating passage. Due to the relief of the high pressure fluid, surge pressure which is usually observed when the fluid actuator performs a pumping function is prevented from occurrence. As described above, although the counterbalance valve of the present invention is simple in construction, it can achieve both the function of a counterbalance valve and a relief function.

BRIEF DESCRIPTION OF THE DRAWINGS

An embodiment of the present invention, which is carried out in a driving system of a crawler vehicle, will now be explained with reference to the accompanying drawings, wherein.

EMBODIMENT

Figure 1:
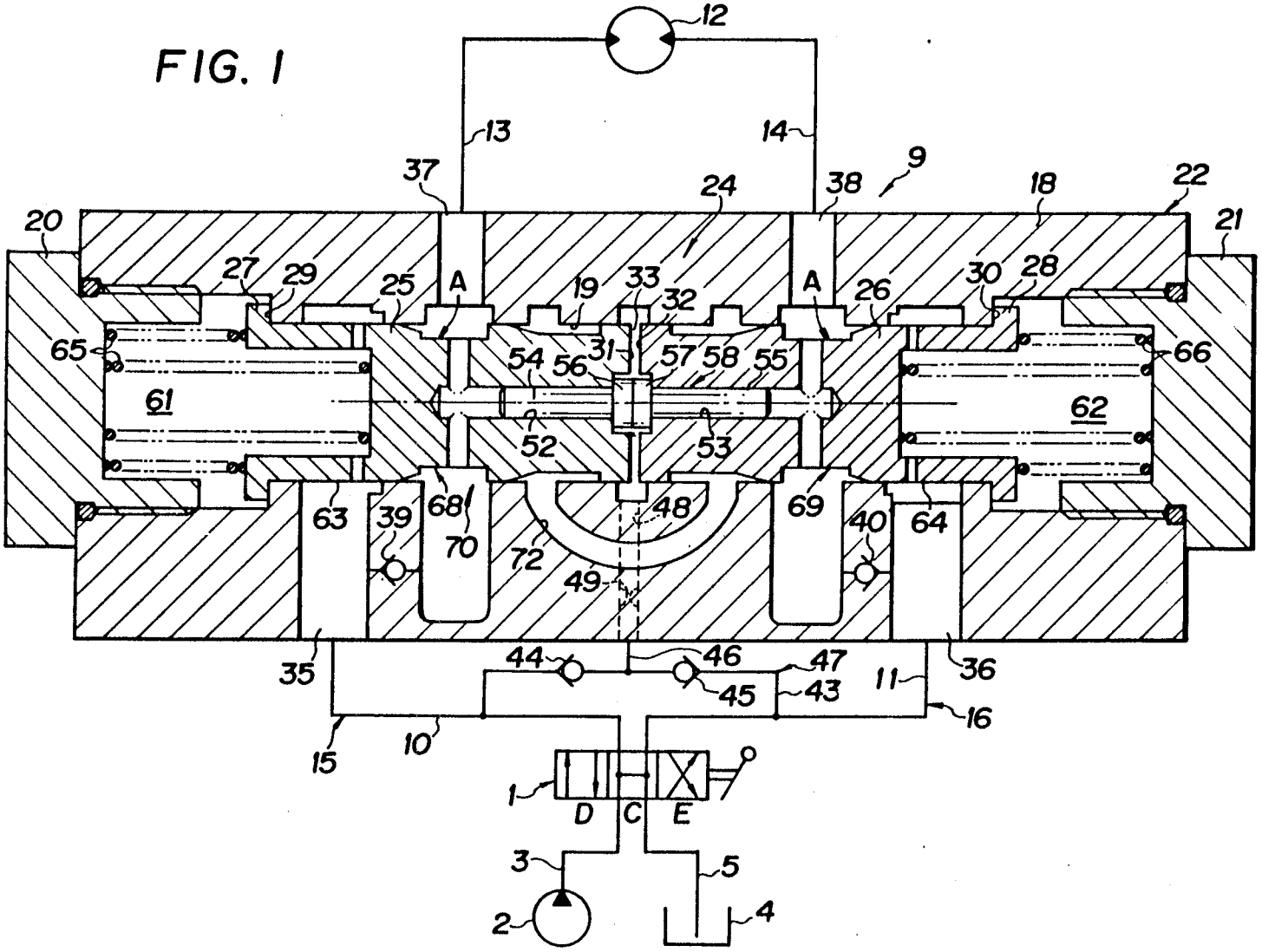
FIG. 1 is a cross-sectional view of the embodiment of the present invention showing the control valve in a neutral position.
Figure 2:
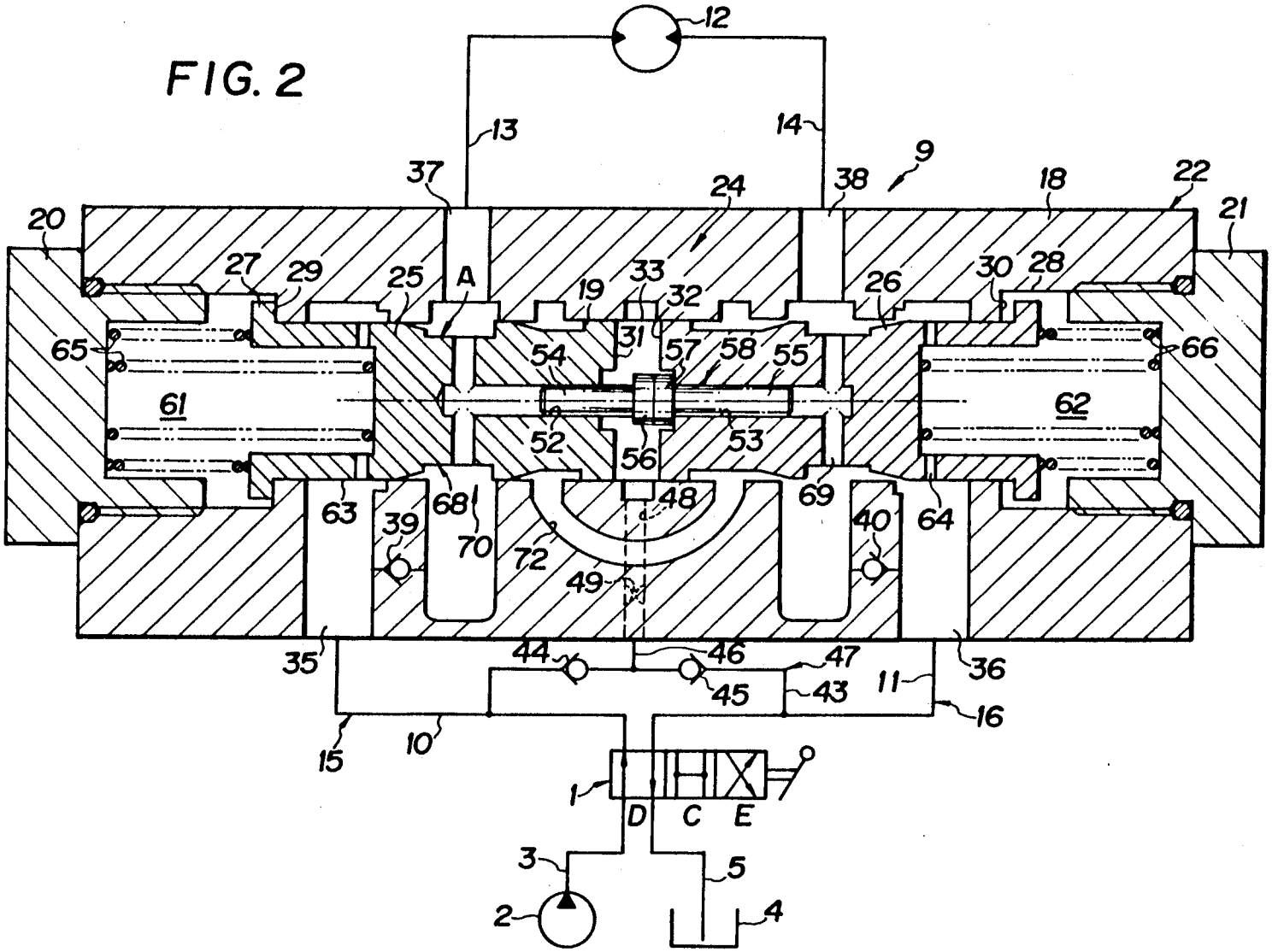
FIG. 2 is a cross-sectional view, like FIG. 1 showing the control valve in an operational position.
Figure 3:
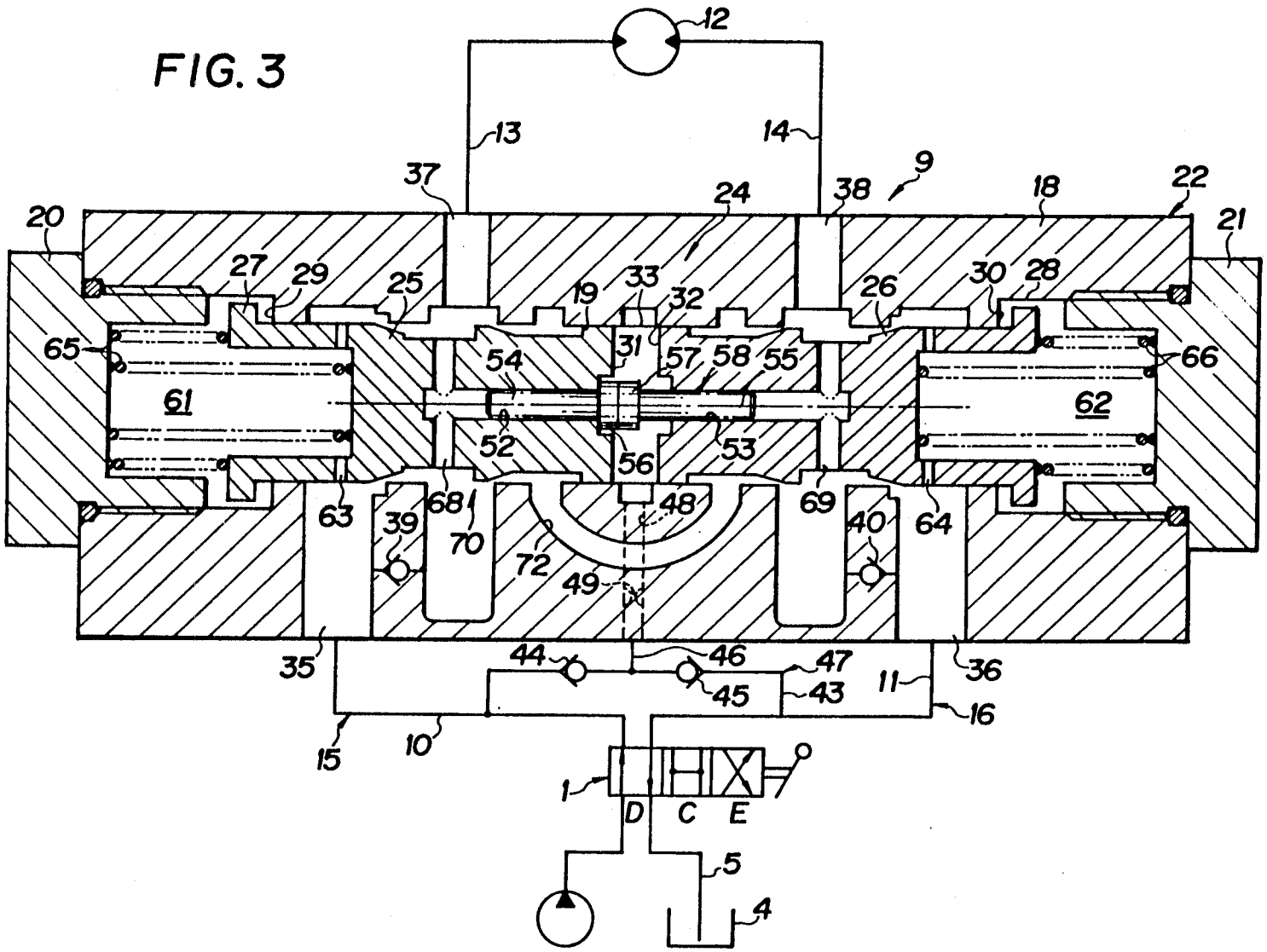
FIG. 3 is a cross-sectional view, like FIG. 1 showing an embodiment of the invention having an actuator mounted thereon in position when a crawler is descending on the down hill.

Referring to FIGS. 1 to 3, reference numeral 1 generally denotes a directional control valve, and the directional control valve 1 and a fluid pump 2 are communicated with each other by a supply passage 3, while the directional control valve 1 and a tank 4 are communicated with each other by an exhaust passage 5.

Reference numeral 9 generally denotes a counterbalance valve with a relief function, and the counterbalance valve 9 and the directional control valve 1 are communicated with each other by a pair of first supply and exhaust lines 10 and 11 while the counterbalance valve 9 and a fluid actuator 12 which drives a crawler vehicle (not shown) are communicated with each other by a pair of second supply and exhaust lines 13 and 14.

The first supply and exhaust lines 10 and 11 and the second supply and exhaust lines 13 and 14 constitute as a whole a pair of supply and exhaust lines 15 and 16 of the present invention which communicates the directional control valve 1 with the fluid actuator 12. Thus, the counterbalance valve 9 is disposed in the supply and exhaust lines 15 and 16, as described above.

The counterbalance valve 9 has a body 18 formed in block, which body has a spool chamber 19 formed and extending linerly therein. The spool chamber 19 has an appropriate cross section, such as a circular cross section. As it will be explained in detail later, ends of first passages 35 and 36, ends of second passages 37 and 38, and ends of a communicating passage 72 are open to the spool chamber 19, respectively. Further, the longitudinal ends of the body 18 have caps 20 and 21 screwed therein, and thus, the ends of the spool chamber 19 are closed by the caps 20 and 21. The body 18, and the caps 20 and 21 as a whole constitute a casing 22 which has a spool chamber 19 formed therein.

Reference numeral 24 generally denotes a spool which is sealingly and slidably inserted in the spool chamber 19, and the spool 24 is composed of two divided spools 25 and 26, which are divided at the center of the longitudinal direction so that they correspond to the supply and exhaust lines 15 and 16, respectively.

Each of the divided spools 25 and 26 has a cylindrical shape with a cross section corresponding to that of the spool chamber 19, and the divided spools 25 and 26 also have flanges 27 and 28, respectively, at the longitudinal outer ends thereof, which flanges can abut against shoulders 29 and 30, respectively, formed in the body 18.

When the divided spools 25 and 26 are moved longitudinally towards the inside of the body 18 until their flanges 27 and 28 abut the shoulders 29 and 30, their longitudinal movements towards the inside of the body 18 are limited at the innermost positions A as illustrated in FIG. 1. As a result, the divided spools 25 and 26 can move longitudinally only in outward directions from the innermost positions A. Further, when the divided spools 25 and 26 are stopped at the innermost positions A, a gap 33 is formed between the inner surfaces 31 and 32, which face to each other, of the divided spools 25 and 26.

The divided spools 25 and 26 are disposed on an axis in this embodiment, however, it is not essential for the divided spools 25 and 26 to be disposed in an axis.

As described above, reference numerals 35 and 36 denote the first passages formed in the body 18, and ends of the first passages 35 and 36 are connected to the first supply and exhaust lines 10 and 11, respectively, and the other ends of the first passages 35 and 36 open into the spool chamber 19. Further, as described above, reference numerals 37 and 38 denote the second passages formed in the body 18, and ends of the second passages 37 and 38 are connected to the second supply and exhaust lines 13 and 14, respectively, and the other ends of the second passages 37 and 38 open into the spool chamber 19 at positions longitudinally inner than those where the first passages 35 and 36 open.

When the divided spools 25 and 26 are at the innermost positions A, as illustrated in FIG. 1, the communication between the first and second passages 35 and 37 and the communication between the first and second passages 36 and 38 are prevented by the divided spools 25 and 26, respectively. Further, when the divided spools 25 and 26 are moved longitudinally towards the outside from the innermost positions A, the first and second passages 35 and 37 are communicated with each other, and also the first and second passages 36 and 38 are communicated with each other (see FIG. 3).

Reference numerals 39 and 40 denote check valves which are accommodated in the counterbalance valve 9 and which are disposed between the first and second passages 35 and 37 and between the first and second passages 36 and 38, respectively. The check valve 39 only permits the flow from the first supply and exhaust line 10 to the second supply and exhaust line 13, and similarly, the check valve 40 only permits the flow from the first supply and exhaust line 11 to the second supply and exhaust line 14.

Reference numeral 43 denotes a selective passage, one end of which is connected to the first supply and exhaust line 10 and the other end of which is connected to the first supply and exhaust line 11, and a pair of check valves 44 and 45, which only permit the flow towards the center of the selective passage 43, are disposed in the selective passage 43. As a result, a high pressure fluid is selectively taken out at a position between the check valves 44 and 45 from the supply and exhaust lines 15 and 16.

Further, an intermediate passage 46 is connected to the selective passage 43 at a position between the check valves 44 and 45. The selective passage 43, the check valves 44 and 45, and the intermediate passage 46 as a whole constitute a high pressure selection mechanism 47, which selectively takes out the high pressure fluid from the supply side of the supply and exhaust lines 15 and 16.

Reference numeral 48 denotes a high pressure passage formed in the casing 22, one end of the high pressure passage 48 is connected to the intermediate passage 46 and the other end of the high pressure passage 48 is open at the longitudinally center of the spool chamber 19. As a result, the high pressure fluid taken out by the high pressure selection mechanism 47 is introduced into the spool chamber 19, i.e., the gap 33, between the divided spools 25 and 26 through the high pressure passage 48, and serves on the inner surfaces 31 and 32 of the divided spools 25 and 26 so as to affect the divided spools 25 and 26 the longitudinal fluid force directed to the outwards. Reference numeral 49 denotes a choke disposed in the high pressure passage 48.

The divided spools 25 and 26 have coaxial holes 52 and 53, respectively, extending longitudinally from their inner surfaces 31 and 32, respectively. A first rod member 54 and a second rod member 55 are sealingly and slidably inserted into the holes 52 and 53, respectively. The first and second rod members 54 and 55 have flanges 56 and 57, respectively, at innermost portions thereof, which portions project inwardly from the divided spools 25 and 26, and the flanges 56 and 57 can abut against the inner surfaces 31 and 32, respectively. The innermost surfaces of the flanges 56 and 57, which face each other, always abut to each other.

The first and second rod members 54 and 55 as a whole constitute a rod 58, ends of which are inserted into the holes 52 and 53 and which has flanges 56 and 57 at the center thereof. When the divided spools 25 and 26 are disposed in an axis as shown in this embodiment, the rod 58 may be integrally constructed by combining the first and second rod members 54 and 55. However, it is more preferred that the rod 58 is constructed with the separated rod members 54 and 55 as described with reference to the embodiment since troubles, such as seizure between the divided spools 25 and 26 and the rod 58, which may be caused by manufacturing error in the divided spools 25 and 26, can be prevented.

Spring chambers 61 and 62 are formed at the ends of the spool chamber 19, respectively, which ends are longitudinally outside of the divided spools 25 and 26, respectively. The spring chambers 61 and 62 are always communicated with the first passages 35 and 36, respectively, through transfer passages 63 and 64. As a result, the fluid in the supply and exhaust lines 15 and 16 are introduced to the outer surfaces of the divided spools 25 and 26, respectively, through the transfer passages 63 and 64.

Reference numerals 65 and 66 denote springs installed within the spring chambers 61 and 62, respectively, and the springs 65 and 66 urge the divided spools 25 and 26 toward the innermost positions A, respectively.

Reference numerals 68 and 69 denote inner passages formed in spools 25 and 26, respectively, wherein one end of each of the inner passages 68 and 69 are communicated with the second passages 37 and 38, respectively, and the other end of each of the inner passages 68 and 69 are connected to the bottoms of the holes 52 and 53, respectively. As a result, the fluids in the supply and exhaust passages 15 and 16 flow into the bottoms of the holes 52 and 53 through the inner passages 68 and 69, respectively, and are introduced to the outer surfaces of the first and second rod members 54 and 55, i.e., both the sides of the rod 58.

The holes 52 and 53, the rod 58, and the inner passages 68 and 69 as a whole constitute a moving means 70 of the present invention which moves one of the divided spools 25 and 26 in such a direction that the flow area increases in response to an increased pressure at the exhaust side of the supply and exhaust lines 15 and 16, i.e., to the outward along the longitudinal direction, when the pressure increases beyond a predetermined pressure due to a pumping function of the fluid actuator 12.

As described above, reference numeral 72 denotes the communicating passage formed in the casing 22, the first end of the communicating passage 72 opens into the spool chamber 19 at a position longitudinally inside of the second passage 37, and the second end of the communicating passage 72 opens into the spool chamber 19 at a position longitudinally inside of the second passage 3. The first end of the communicating passage 72 is shut and isolated from the second passage 37 when the divided spool 25 is positioned at the innermost position A (FIG. 1), while the first end of the communicating passage is communicated with the second passage 37 when the divided spool 25 is longitudinally moved to the outside from the innermost position A (FIG. 3). Similarly, the second end of the communicating passage 72 is shut and isolated from the second passage 38 when the divided spool 26 is positioned at the innermost position A (FIG. 1), while the second end of the communicating passage 72 is communicated with the second passage 38 when the divided spool 26 is longitudinally moved to the outside from the innermost position A (FIG. 3). As described above, when both the divided spools 25 and 26 are longitudinally moved to the outside from the innermost positions A, the supply and exhaust lines 15 and 16 are communicated with each other through the communicating passages 72 (see FIG. 3).

The operation of the embodiment of the present invention will now be explained.

First, the directional control valve 1 is switched from the neutral position C (FIG. 1) to, for example, a parallel flow position D (FIG. 2), and the high pressure fluid delivered from the fluid pump 2 is flown into the supply side 15 of the supply and exhaust lines, and at the same time, the exhaust side 16 of the supply and exhaust lines is communicated with the tank 4.

The high pressure fluid flown into the supply and exhaust line 15 flows into the fluid actuator 12 after it passes through the check valve 39 of the counterbalance valve 9. After the fluid flow rotates the fluid actuator 12, it is exhausted into the supply and exhaust line 16 as a low pressure fluid. In this case, the high pressure fluid flown into the supply and exhaust line 15 is selected by the high pressure selection mechanism 47 and is taken out into the high pressure passage 48, and thereafter, the high pressure fluid flows into the spool chamber 19 surrounded by the divided spools 25 and 26, i.e., the gap 33, through the high pressure passage 48, and acts on the inner surfaces 31 and 32 of the divided spools 25 and 26. The high pressure fluid in the supply and exhaust line 15 is also introduced to the outer left surface of the divided spool 25 through the transfer passage 63, and accordingly, the fluid forces acting on the divided spool 25 are balanced, and therefore, the divided spool 25 corresponding to the supply side 15 of the supply and exhaust lines continues to remain at the innermost position A.

Contrary to this, the low pressure fluid in the supply and exhaust line 16 is introduced to the outer right surface of the divided spool 26 through the transfer passage 64, and accordingly, there occurs a difference in pressures acting on the inner left surface 32 and the outer right surface of the divided spool 26. As a result, only the divided spool 26 corresponding to the exhaust side 16 of the supply and exhaust lines longitudinally moves to the outside, i.e., to the right in FIG. 2, in response to the pressure in the supply side 15 of the supply and exhaust lines while the spring 66 is compressed, and thus the flow area of the supply and exhaust line 16 is adjusted. More specifically, since the flow area of the supply and exhaust line 16 is increased due to the movement of the divided spool 26, the low pressure fluid flown from the fluid actuator 12 is exhausted to the tank 4 through the supply and exhaust line 16, directional control valve 1 and the exhaust passage 5.

Thus, the fluid actuator 12 rotates at a predetermined speed in response to the difference in pressures in the supply side and the exhaust side of the supply and exhaust lines, and the crawler vehicle is advanced.

In this case, since the outer surface, i.e., left surface, of the first rod member 54 is supplied with the high pressure fluid in the supply and exhaust line 15 through the inner passage 68, the rod 58, i.e., the first and second rod members 54 and 55, integrally moves to the opposite side, i.e., to the right in FIG. 2, by the fluid force caused by the high pressure fluid until the flange 57 abuts the inner surface 32 of the divided spool 26.

When the crawler vehicle goes on descending on the downhill and the fluid actuator 12 performs a pumping function, i.e., when it sucks fluid from the supply side 15 of the supply and exhaust lines and delivers fluid into the exhaust side 16 of the supply and exhaust lines, the pressure in the supply and exhaust line 15, and accordingly, that in the high pressure passage 48, which is communicated with the supply and exhaust line 15 through the high pressure selection mechanism 47, are lowered.

Contrary to this, due to the pumping function of the fluid actuator 12, the pressure in the supply and exhaust line 16, i.e., the pressure in the second supply and exhaust passage 14, is enhanced. As a result of decrease of pressure in the high pressure passage 48, the divided spool 26 corresponding to the exhaust side is longitudinally moved to the innermost position A while it is urged by the spring 66. Due to such longitudinal movement of the divided spool 26 towards the innermost position A, the flow area of the supply and exhaust line 16 is gradually decreases, and the pressure in the second supply and exhaust passage 14 is further increased. The increased pressure in the second supply and exhaust passage 14 serves as a back pressure to the fluid actuator 12 and applies a braking force to the actuator 12. In this case, the fluid, the pressure of which is enhanced, in the supply and exhaust passage 16 is introduced to the outer surface, i.e., the right surface, of the second rod member 55, i.e., the right surface of the rod 58, through the inner passage 69, and accordingly, the rod 58 is moved to one direction, i.e., to the left in FIG. 3 until the flange 56 of the rod 58 abuts the inner surface 31 of the divided spool 25.

Further, when the flow area of the supply and exhaust line 16 is remarkably decreased by the divided spool 26 so that the pressure in the second supply and exhaust passage 14 is enhanced to a certain high pressure which is higher than a predetermined pressure, the fluid force acting on the rod 58 exceeds the urging force by the return spring 65. Then, receiving said high pressure, the moving means 70 is actuated so that the rod 58 longitudinally moves the divided spool 25, which corresponds to the supply side 15 of the supply and exhaust lines, outwardly, i.e., to the left, so as to increase flow area.

Contrary to this, since the divided spool 26 corresponding to the exhaust side 16 of the supply and exhaust line is still moving towards the innermost position A, the divided spool 25 is moving at a position away from the innermost position A. As a result, the left and right ends of the communicating passage 72 are communicated with the second passages 37 and 38, respectively (see FIG. 3). Thus, the exhaust side 16 of the supply and exhaust lines and the supply side 15 of the supply and exhaust lines are communicated with each other through the communicating passage 72, and accordingly, the fluid, the pressure of which exceeds the predetermined pressure, in the supply and exhaust line 16 is relieved to the supply and exhaust line 15 through the communicating passage 72, and occurrence of surge pressure in the fluid circuit is prevented.

As described above, although the counterbalance valve 9 of this embodiment is simple in construction, it performs both a function of a counterbalance valve and a relief function.

When the directional control valve 1 is switched from the flow position to the neutral position C, the counterbalance valve 9 operates in a foregoing manner. Further, in the above-explanation, the directional control valve 1 has been switched from the neutral position C to a parallel flow position D so that the supply and exhaust line 15 has been at the supply side and so that the supply and exhaust line 16 has been at the exhaust side. However, when the directional control valve 1 is switched from the neutral position C to a cross flow position E so that the supply and exhaust line 16 is at the supply side and so that the supply and exhaust line 15 is at the exhaust side, the counterbalance valve 9 operates in a manner similar to that described above.

In the embodiment described above, the transfer passages 63 and 64 are formed in the divided spools 25 and 26, however, according to the present invention, the transfer passages may be formed in the casing 22. In addition, the present invention may be carried out in a fluid circuit for driving a winch or the like, wherein one side is always supply side of the supply and exhaust lines and the other is always exhaust side of the supply and exhaust lines.

As described above, according to the present invention, a counterbalance valve is provided with a relief function which is simple in the whole construction and which can be manufactured at a low cost.

What is claimed is:

1. A counterbalance valve with a relief function, which valve is disposed in a pair of supply and exhaust lines communicating a directional control valve with a fluid actuator, wherein said counterbalance valve comprises:

a flow area at a supply side and an exhaust side of said supply and exhaust lines a means for adjusting said flow area at said exhaust side of said supply and exhaust lines in response to a pressure at a supply side of said supply and exhaust lines two divided spools, which correspond to said supply and exhaust lines, respectively, and which compose a spool of said counterbalance valve;

a means for moving one of said divided spools at said supply side of said supply and exhaust lines in such a direction that said flow area at said supply side of said supply and exhaust lines increases in response to an increased pressure at said exhaust side of said supply and exhaust lines, when said pressure increases beyond a predetermined pressure due to a pumping function of said fluid actuator; and a passage for relieving fluid at increased pressure at said exhaust side of said supply and exhaust lines so that when said moving means is actuated said fluid at said increased pressure is relieved to said supply side of said supply and exhaust lines.

2. A counterbalance valve according to claim 1 wherein said means for moving one of said divided spools is a rod member.

3. A counterbalance valve with a relief function, comprising:

a flow area at a supply side and an exhaust side of said supply and exhaust lines spools, which are disposed in a pair of supply and exhaust lines, respectively, communicating a directional control valve with a fluid actuator, and which comprise a means for adjusting said flow area at an exhaust side of said supply and exhaust lines in response to a pressure at a supply side of said supply and exhaust lines;

rod members, disposed in said spools, respectively, for moving one of said spools at said supply side of said supply and exhaust lines in such a direction that said flow area at said supply side of said supply and exhaust lines increases in response to an increased pressure at said exhaust side of said supply and exhaust lines, when said pressure increases beyond a predetermined pressure due to a pumping function of said fluid actuator; and a passage for relieving fluid at increased pressure at said exhaust side of said supply and exhaust lines so that when said rod member is actuated said fluid at increased pressure is relieved to said supply side of said supply and exhaust lines.

* * * * *